US011076682B2

(12) United States Patent
Silverberg

(10) Patent No.: US 11,076,682 B2
(45) Date of Patent: Aug. 3, 2021

(54) COSMETIC APPLICATION WAND

(71) Applicant: Guide Beauty LLC, Rochester, NY (US)

(72) Inventor: Terri Silverberg, Winter Park, FL (US)

(73) Assignee: GUIDE BEAUTY LLC, Rochester, NY (US)

( * ) Notice: Subject to any disclaimer, the term of this patent is extended or adjusted under 35 U.S.C. 154(b) by 178 days.

(21) Appl. No.: 16/270,250

(22) Filed: Feb. 7, 2019

(65) Prior Publication Data

US 2019/0239622 A1 Aug. 8, 2019

Related U.S. Application Data

(60) Provisional application No. 62/627,860, filed on Feb. 8, 2018.

(51) Int. Cl.

| | |
|---|---|
| ***A45D 40/28*** | (2006.01) |
| ***A45D 40/26*** | (2006.01) |
| ***A45D 34/04*** | (2006.01) |
| ***A46B 5/02*** | (2006.01) |

(52) U.S. Cl.

CPC ..... *A45D 40/28* (2013.01); *A45D 34/045* (2013.01); *A45D 40/262* (2013.01); *A45D 40/265* (2013.01); *A46B 5/02* (2013.01); *A46B 2200/106* (2013.01)

(58) Field of Classification Search

CPC ..... A45D 40/28; A45D 40/26; A45D 34/045; A45D 34/046; A45D 40/262; A45D 40/265; A45D 2200/1072; A45D 40/18; A45D 40/20; A46B 5/002; A46B 2200/1053; A46B 2200/106

USPC ..... 401/119, 123–126, 128, 130, 132, 220, 401/226; 132/218, 320, 216; D28/36

See application file for complete search history.

(56) References Cited

U.S. PATENT DOCUMENTS

| | | | | |
|---|---|---|---|---|
| D2,927 | S | 2/1868 | Pusey | |
| 273,444 | A | 3/1883 | Bixby | |
| 1,139,348 | A | 5/1915 | Craig | |
| 2,868,212 | A | 1/1959 | Schoenberger | |
| 3,084,938 | A | 4/1963 | Kapanowski | |
| 3,121,938 | A | 2/1964 | Lind et al. | |
| 3,516,423 | A * | 6/1970 | Seidler | A45C 11/00 132/216 |
| 4,165,755 | A * | 8/1979 | Cassai | A45D 40/265 132/218 |
| 4,283,854 | A | 8/1981 | Austin | |

(Continued)

FOREIGN PATENT DOCUMENTS

| | | |
|---|---|---|
| FR | 2886112 A1 | 12/2006 |
| FR | 2933281 B1 | 1/2010 |

(Continued)

*Primary Examiner* — Cris L. Rodriguez
*Assistant Examiner* — Sharon E Kennedy
(74) *Attorney, Agent, or Firm* — Nixon Peabody LLP; Elizabeth W. Baio; Francesco de Rege

(57) ABSTRACT

This invention relates to assemblies, components, and methods for application of cosmetic products. For example, a cosmetic applicator wand in the form of an elongated tool including a region for gripping by a user, an enlarged element optionally including a groove, where the wand can be coupled to an applicator. The assemblies are designed to be easy and comfortable to use.

15 Claims, 8 Drawing Sheets

(56) References Cited

U.S. PATENT DOCUMENTS

| | | | | | |
|---|---|---|---|---|---|
| D272,099 | S | * | 1/1984 | Cassai | A46B 15/0055 D28/7 |
| 4,621,387 | A | | 11/1986 | Noser | |
| 4,880,382 | A | * | 11/1989 | Moret | A46B 15/0055 433/118 |
| D349,512 | S | | 8/1994 | Law | |
| 5,617,884 | A | | 4/1997 | Allison et al. | |
| D383,307 | S | | 9/1997 | Klein et al. | |
| 5,662,423 | A | | 9/1997 | Walden | |
| 6,105,585 | A | * | 8/2000 | Thomas | A45D 34/042 132/216 |
| 6,131,231 | A | | 10/2000 | Huang | |
| 6,305,051 | B1 | | 10/2001 | Cho | |
| 6,341,912 | B1 | * | 1/2002 | Gueret | A45D 34/045 401/118 |
| 6,508,255 | B1 | * | 1/2003 | Glover | A45D 40/0087 132/216 |
| 6,732,411 | B2 | | 5/2004 | Vidal | |
| 7,478,958 | B2 | * | 1/2009 | Ramet | A45D 40/26 401/123 |
| 7,549,686 | B2 | | 6/2009 | Watanabe | |
| 8,893,733 | B2 | * | 11/2014 | Welt | A61C 15/046 132/323 |
| 8,939,159 | B2 | | 1/2015 | Yeo et al. | |
| 10,111,513 | B2 | | 10/2018 | Rhoades et al. | |
| 2011/0170937 | A1 | * | 7/2011 | Gueret | A45D 40/265 401/130 |
| 2011/0174328 | A1 | * | 7/2011 | Cerutti | A46B 15/0091 132/200 |
| 2012/0043452 | A1 | | 2/2012 | Karmatz | |
| 2013/0220362 | A1 | * | 8/2013 | Rogers | A45D 33/008 132/301 |
| 2014/0109928 | A1 | * | 4/2014 | Simard | A45D 40/265 132/200 |
| 2014/0251359 | A1 | * | 9/2014 | Urrechaga | A45D 40/26 132/200 |
| 2016/0081456 | A1 | * | 3/2016 | Grund | A45D 34/04 132/200 |
| 2017/0156474 | A1 | | 6/2017 | Fishcer et al. | |
| 2017/0181524 | A1 | * | 6/2017 | Thiebaut | A45D 34/045 |
| 2018/0146767 | A1 | | 5/2018 | Prade | |
| 2020/0069031 | A1 | * | 3/2020 | Gabon | A45D 40/262 |
| 2020/0085168 | A1 | * | 3/2020 | Pang | A46B 15/0006 |

FOREIGN PATENT DOCUMENTS

| | | | | |
|---|---|---|---|---|
| FR | 2955019 | * | 1/2010 | A45D 40/20 |
| GB | 2490518 | * | 5/2011 | A45D 40/20 |
| JP | 2002306233 A | | 10/2002 | |
| JP | 2015-126822 | * | 7/2015 | A45D 34/04 |
| WO | 2011/131972 A1 | | 10/2011 | |
| WO | 2015/069286 A1 | | 5/2015 | |

* cited by examiner

COSMETIC APPLICATION WAND

RELATED APPLICATIONS

This application claims benefit under 35 U.S.C. § 119(e) of the U.S. Provisional Application No. 62/627,860 filed Feb. 8, 2018, the content of which is incorporated herein by reference in its entirety.

FIELD OF THE INVENTION

This invention relates to assemblies, components, and method for application of cosmetic products. For example, a cosmetic applicator wand and its use with an applicator for applying an eyeliner formulation is disclosed.

BACKGROUND

Applicators for cosmetic products (e.g., vessels, tools, and similar devices used to dispense and apply chemical formulations of makeup or removing these from the face) have not evolved significantly since the 1960s. Existing applicators are designed primarily to be aesthetically appealing and are typically not designed to ease the application of the cosmetic formula. Such applicators typically require users to rely on arm strength in holding the applicator with their hands, with arms raised and distanced from the face. Precise application of cosmetic formulas also requires steadiness, adequate vision, adept fine motor skills, eye-hand coordination, visual attention, depth perception, skill, and/or training to achieve desired results. For example, proper application of eyeliner or mascara can be difficult, and many people lack one or more of the attributes required to achieve the desired result. Consequently, some people avoid wearing eyeliner and mascara, spend additional time re-applying or modifying a cosmetic formula, accept an inferior application, or avoid applying the mascara or eyeliner themselves, for example, paying a professional makeup artist to apply the cosmetic formula for them. For some, eyeliner is the one of the most difficult types of makeup to apply, as it requires a steady free hand to draw a straight line. Typically, eyeliner application requires two hands since a user often stretches a closed eyelid onto which the eyeliner is being applied with one hand while applying the eyeliner with the other hand.

Existing cosmetic formula-applicators often have handles, grips, lids, etc. that are considered difficult to hold. This is especially true for an increasingly important segment of the population, namely, the elderly and/or physically handicapped or impaired persons. These individuals often experience diminution of muscle control and/or strength in their extremities, tremors, stiffness in joints, and/or poor eyesight. Some such impairments may be associated with a degenerative disease such as Parkinson's Disease, Multiple Sclerosis, Arthritis, Essential Tremors, or the like. Clearly, the difficulties in applying cosmetics are exacerbated for these individuals. In addition, some of these individuals lack the support, for example, of a caregiver or lack funds to hire a makeup artist to apply makeup for them.

Therefore, there exists a need for improved cosmetic applicators that address one or more of these deficiencies.

SUMMARY

In general, the inventions described herein relate to applicators for applying a cosmetic formulation that are designed for convenient and ergonomic use as well as being stylish. For example, the applicators can include an eyeliner wand (or for use with another cosmetic formulation) that is shaped and designed for easy use, such as for elderly users or users with disabilities or impairments. The applicators are also designed to enhance ease, speed and proficiency of application for a typical makeup user without notable physical limitations.

In one aspect, the invention comprises a cosmetic applicator wand (e.g., an eyeliner wand) in the form of an elongated tool. The wand comprises a stem portion disposed between a first end and a second end of the elongated tool, the stem portion including a region configured to be gripped by a user. The wand also comprises an enlarged element (e.g., a ring-like element) disposed between the region configured to be gripped by the user and an applicator coupling element. Optionally, the region configured to be gripped by the user has a cross sectional shape of a circle, an oval, or an n-sided shape, where n is an integer between three and 10. Optionally the region configured to be gripped by the user is textured for secure gripping by the user. Optionally, the stem is tapered, having a larger cross section area at a position proximate to the enlarged element and a smaller cross sectional area at a position distal from the enlarged element. Optionally, the enlarged element includes a groove such as the index finger groove that has an arcuate surface. Optionally, the enlarged element has a diameter smaller than about 5 cm. In some options, the applicator coupling element is configured to removably couple with a handle of an applicator wherein a primary axis of the elongated tool and a primary axis of the applicator handle are substantially parallel. In some options, the coupling element on the wand and the handle of the applicator are configured as a male to female pair. That is, in some options, the coupling element comprises an indentation for placement of one end of an applicator handle therein, while in some other options, the coupling element comprise a protrusions and the applicator handle includes an indentation for placement of the protrusion therein.

In another aspect, the invention comprises a cosmetic applicator. The cosmetic applicator comprises a shaft and an applicator tip, wherein the applicator tip is curved away from a principle axis of the shaft, and the applicator tip comprises a through hole configured as a peek or see-through hole. Optionally, the applicator tip comprises a silicone, thermoplastic polyurethane (TPU), thermoplastic elastomers (TPE), or combinations thereof. Optionally, the applicator tip comprises at least two working surfaces for applying a cosmetic formula to skin, such as for applying eyeliner to an eyelid. Optionally, the applicator can be removably attached to a holder, such as, but not limited to, the cosmetic applicator wand described above.

In another aspect, the invention comprises an assembly for application of a cosmetic formula. The assembly comprises a cosmetic applicator wand in the form of an elongated tool and an applicator comprising an applicator shaft and an applicator tip, the applicator tip comprising an application surface for applying the cosmetic formula (e.g., eyeliner, mascara, or the like) to skin (e.g., to an eyelid, an eyebrow, eyelashes, or the like). Optionally, the assembly further comprises a vessel configured as a reservoir for the cosmetic formula and configured for sealing to the wand proximate to the first end of the wand.

In yet another aspect, the invention comprises a method for applying a cosmetic formula to a subject or for brushing or otherwise grooming the subject. The method comprises holding the assembly for application of a cosmetic formula as described above using the stem portion of the elongated element and contacting the application surface of an applicator to a desired part of the subject (e.g., an eyelid or eyebrow). Optionally, the method further comprises grounding the elongated element of the assembly against the face of the subject. Optionally, the grounding comprises rolling or sliding the element against the face of the subject. Optionally, the method includes resting an index finger in a groove on the enlarged portion of the assembly, and holding the assembly includes resting a finger in the groove.

The cosmetic applicator wand is generally ergonomic and designed for use even with people having disabilities or impairments such as tremors, arthritis, other challenges that can occur due to age or other reasons, combinations thereof, or the like. The applicator, when used with the assembly or another holder, also provides easy and ergonomic use so that the user can comfortably and gently apply makeup or otherwise treat the skin, eyelashes, eyebrows, or the like.

BRIEF DESCRIPTION OF THE FIGURES

FIG. 1A is an isometric view, FIG. 1B is a side view, and FIG. 1C is a top cross cut view.

FIG. 5A is a side view, FIG. 5B is a cross cut front view, and FIG. 5C is a cross cut side view.

FIG. 6A shows an isometric view, FIG. 6B shows a front view, and FIG. 6C shows a side view.

Figure 1A:
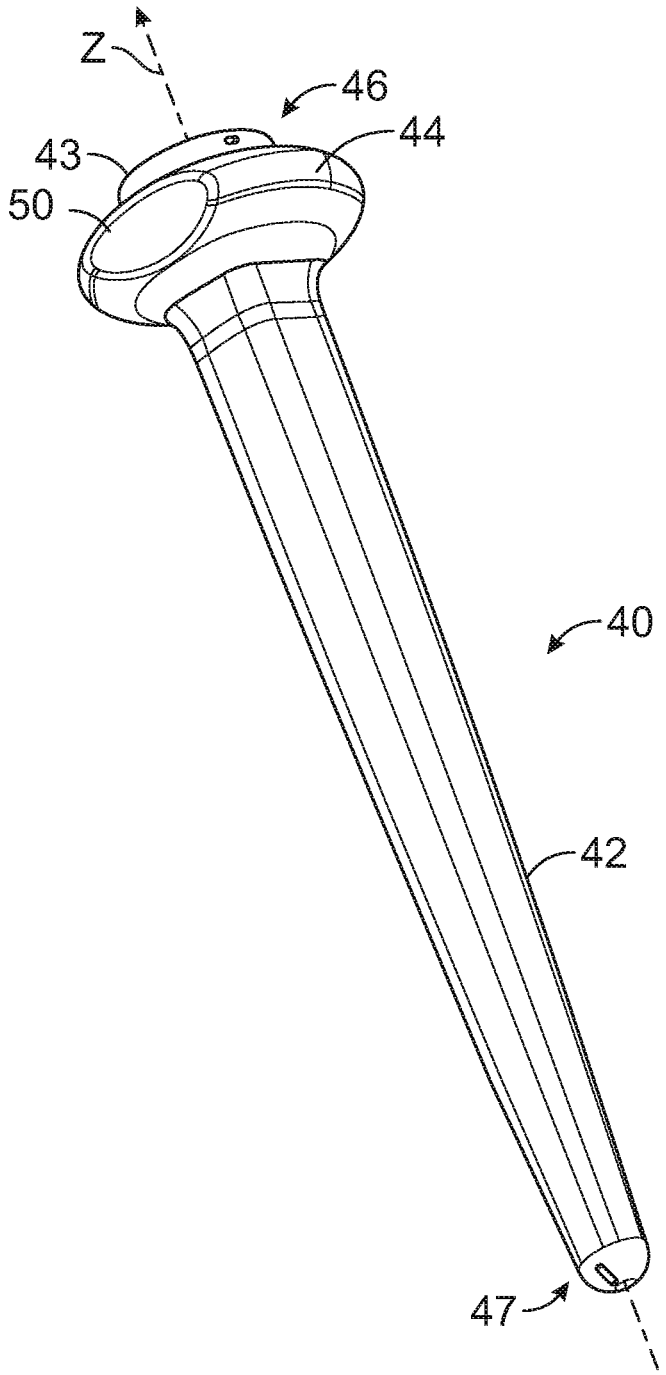
FIGS. 1A-1C show views of a cosmetic applicator wand 40 according to one embodiment.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, the disclosure is to cover all modifications, equivalents, and alternatives falling within the spirit and scope of the invention as defined by the appended claims.

DETAILED DESCRIPTION

The methods, compositions, and structures provided herein are based in part on the realization that applying certain cosmetic formulations (e.g., mascara, eyeliner, and the like) can be challenging, and new handles and applicators would be useful. For example, designs that are ergonomic and elegant as described herein are more readily universally used, including by people having disabilities and impairments that make applying cosmetic formulas particularly challenging.

Figure 1B:
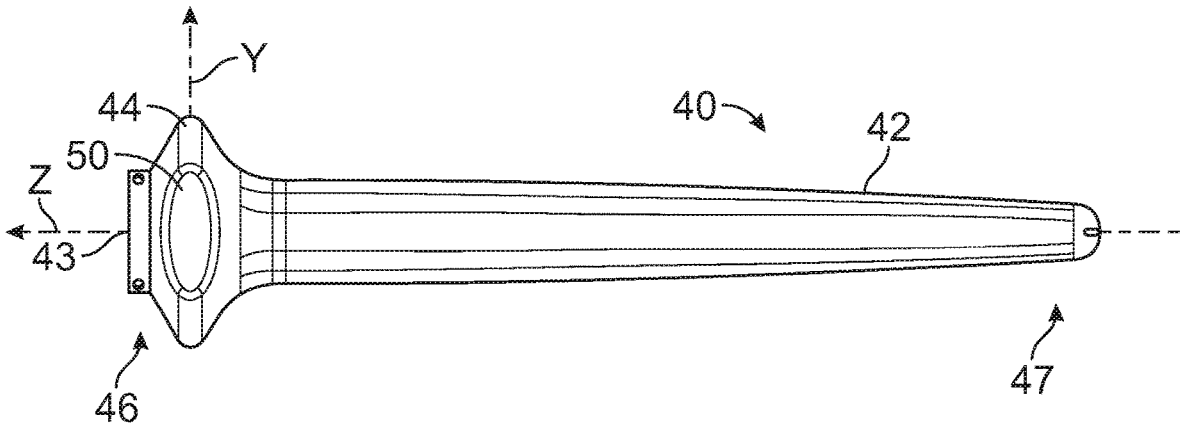
Figure 1C:
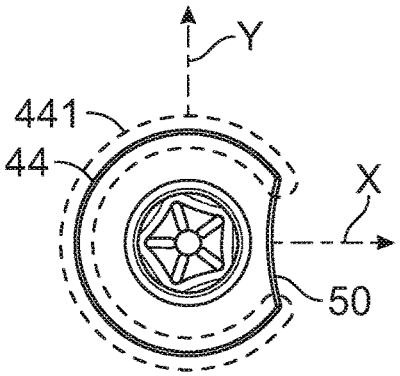

FIG. 1A-1C show views of a cosmetic applicator wand 40 according to one embodiment. Although in the embodiment of FIGS. 1A-1C, the applicator wand 40 is used for applying eyeliner, it is contemplated that the wand 40 may be used with any suitable cosmetic formulation including, but not limited to, mascara, an eyebrow pencil, or the like.

The cosmetic applicator wand 40 is a generally elongated tool, elongated in the direction of principle axis Z, having a first end 46 and a second end 47. The cosmetic applicator wand 40 includes a handle stem 42 configured to be gripped by a user. The applicator wand 40 also includes an applicator coupling portion 43, an enlarged portion, shown here as a ring-like portion 44, and a groove (e.g., a finger rest) 50. The region enclosed by the dashed line 441 show a portion of the ring 44 that is not part of groove 50. These elements will be described in more detail.

The handle stem portion 42 can have any suitable shape, for example, suitable for gripping by the used. For example, in some embodiments, a cross sectional profile through the stem 42 in the plane defined by axis X and Y, outlines a hexagonal shape. It is contemplated that in some embodiments the handle stem can have any suitable shape including round, oval, triangular, rectangular, or another polygonal shape for n sides where n is any number (e.g., n is an integer between 3 and 10). In some embodiments combinations of the profiles can be used, for example, having a cross sectional profile of half of a circle and half of hexagon.

In some embodiments the wand 40 has a varying cross section in the plane defined by X and Y. For example, the cross section can have a larger profile at first end 46 than second end 47, or larger profile at the second 47 end than the first end 46, or varying profiles between the first and second end, e.g., a bulge on stem 42. In some embodiments the shape and size of the profile changes along the direction of axis Z is optimized for ergonomic considerations such as grip, texture, fit and balance for use. In some embodiments the handle can include indentations such as finger grooves or other surface features configure to fit the user's hand securely and ergonomically.

The stem portion can be configured to readily fit in most hand sizes. For example, the stem portion can have a length along the Z axis and disposed between the first end and the second end between about 6 and 12 cm. In some embodiments the diameter of cross section (e.g., maximum linear length of the cross section) is less than about 5 cm (e.g., less than 4 cm, less than 2 cm). In some embodiments this diameter cross section is greater than about 1 cm (e.g., greater than about 2 cm), for example, the diameter cross section is greater than a typical diameter of an eyeliner pensile and is easier and more comfortable to hold.

In some embodiment wand 40 is weighted to be easy to hold with one hand. For example, having a mass so as to weigh less than about 500 g (e.g., less than about 400 g, less than about 300 g, less than about 200 g). In some embodiment the materials for manufacturing the wand 40 are chosen to be a light weight and low density. For example, plastic, rubbers, foams, light wood (e.g., cork), light metals (e.g., aluminum) and combinations of these. In some embodiments the wand includes internal voids such as air bubbles, honeycomb structures or cavities).

In some embodiments, the handle stem 42 is be textured to assist in preventing slippage and/or may include another design or shape. In some embodiments the handle stem is be made of a material with a high coefficient of friction against the skin of a gripping hand. For example, the static coefficient of friction of the material can be greater than about 0.2 (e.g., greater than 0.3, greater than about 0.4, greater than about 0.5). In some embodiments the handle stem comprise one or more of a plastic, rubber, metal, wood, cork or a combination of these materials. In some embodiments the stem includes "form fitting" or soft materials such as foam which indents with contact of the fingers forming complementary indentations in the form of the fingers gripping the wand.

The cosmetic applicator wand 40 includes an enlarged element 44 towards a top or first end 46 between the handle stem 42 and below the applicator coupling portion 43. In some embodiment the enlarged element is ring-like, as shown in the embodiments depicted by FIG. 1A-1C showing a circular cross section which is convex outwards but also includes a groove 50. For example, the groove 50 can be configured to place a finger (e.g., an index finger) or rest against the face.

It is understood that the cross section of the enlarged portion can be configured to be any suitable shape. For example, in some embodiments, a cross sectional profile through the element 44 in the plane defined by axis X and Y, includes any suitable shape including round, oval, triangular, rectangular, or another polygonal shape for n sides where n is any number (e.g., n is an integer between 3 and 10). In some embodiments combinations of the profiles can be used, for example, having a cross sectional profile of half of a circle and half of hexagon. As used herein the diameter of the element refers to the largest straight light distance within the cross sectional profile. In some embodiment, the enlarged element can be a protruding piece that is a portion of a ring, or is in the shape of a sphere, a nub or another shape protruding from the surface. The element 44 can be used as a resting point of the wand against the face, and as such, any shape suitable for this can be used.

The groove 50 is a generally flattened portion on the portion 44 of the wand 40 shaped and positioned such that a user may comfortably fit his or her finger, such as an index finger thereon. For example, the groove may have an arcuate and concave shape in cross section (e.g., independent of the shape of the enlarged area 44) as shown in FIG. 1C, and this shape can generally fit the curvature of a finger, such as an index finger, where it would contact the groove. In some embodiments the groove includes a textured surface thereupon, for example, to help prevent the user's finger from slipping. In some embodiments material are chosen to have low coefficient of friction or otherwise similarly chosen to prevent slipping as described previously with regards the stem handle 42. In some embodiments, one or more of the index, the middle, ring, pinky or even a thumb can be used for placement in the groove, or the groove can be placed against the face.

The groove 50 can provide support, dexterity and precision to the user of the wand 40 in addition to the support, dexterity and precision afforded by the other features of the wand as described herein. The groove can also provide a tactile sensation or indicator for aiding the user to orient the wand. The groove also can prevent the wand 40 to roll when it is placed on a flat surface, such as a vanity table.

Figure 2:
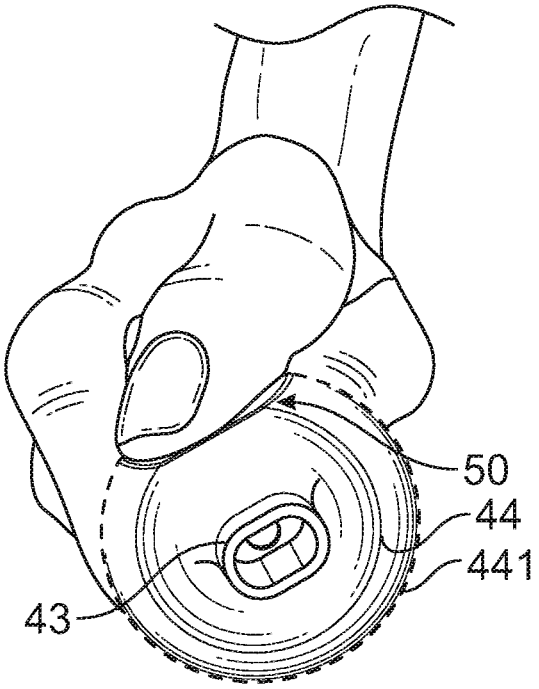
FIG. 2 shows an embodiment for use of the finger groove 50 of a cosmetic applicator wand.
Figure 3:
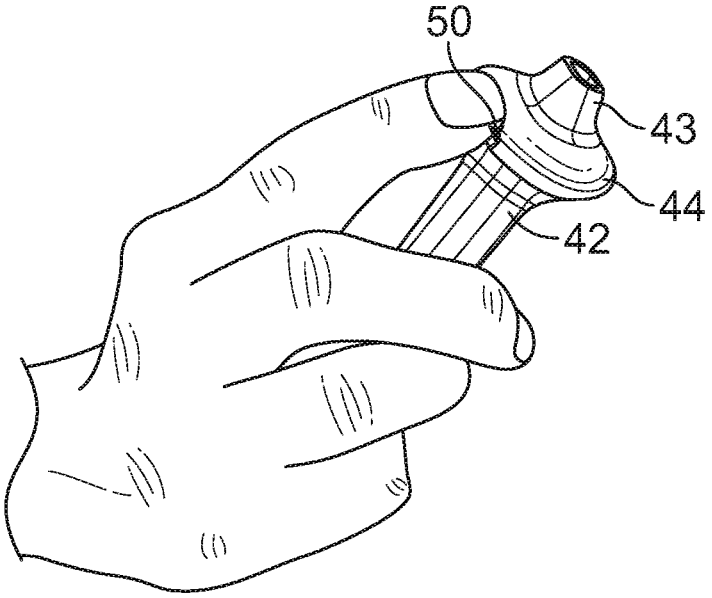
FIG. 3 shows a different orientation of an embodiment for use of the finger groove 50 of the cosmetic applicator wand.

FIG. 2 and FIG. 3 is a picture showing an embodiment for use of the groove 50. In this embodiment, the index finger of one hand rests against the groove while the middle, ring, pinky finger, and thumb contact the stem 42. The user can accordingly have a relaxed, rather than clenched, yet secure grip on the wand 40.

Figure 4:
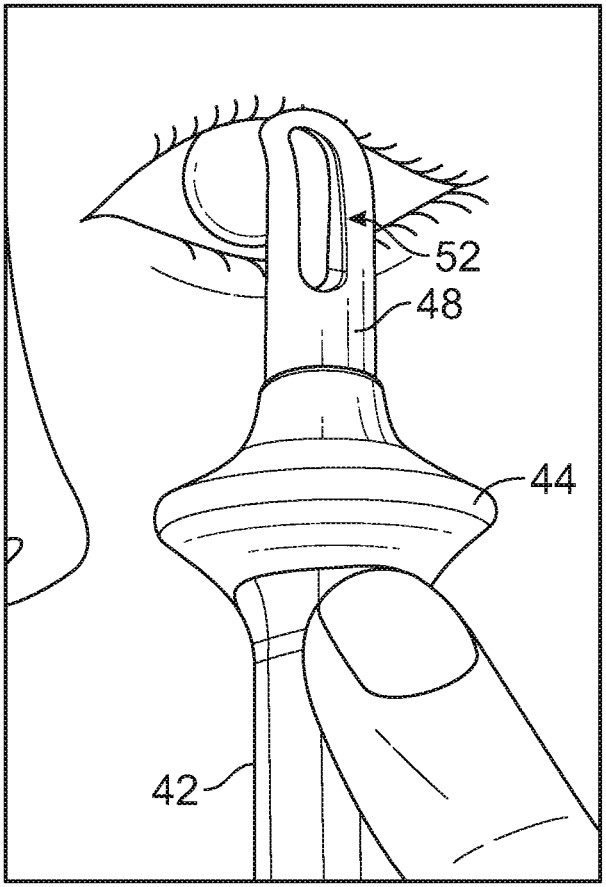
FIG. 4 shows an embodiment for using a wand 40 and including an applicator 48.

FIG. 4 is a picture showing an embodiment for using a wand 40 and including an applicator 48. In this embodiment, the groove is not used for a finger but may be rested against the cheek and provides an orienting surface while applying the tip of applicator 48 to an eyelid. The applicator has a peek hole 52 which is described in more detail below.

In some embodiments, the convex curved surface 441 of the enlarged element 44 is contacts the cheek, rather than the concave or flat groove 50. This allows a user to roll the cosmetic applicator wand 40 (similar to a wheel) across the cheekbone and under-eye area while the applicator 48 easily glides across the eyelid, thereby assisting with providing precision application of eyeliner. It is contemplated that this method may also be used for applying other types of cosmetic formulations.

In either orientation described above, e.g., with the groove 50 or with the convex curved surface 441 of enlarged element 44 against the face, resting of the enlarged element 44 against the user's cheekbone, in a "Rest and Press" or "glide and guide" use can provide a grounding of the wand 40 while the user contacts the applicator 48 to the eye area to apply the eyeliner. This grounding technique can assist in blunting tremors and further steadies the hand during the eyeliner application process, thereby assisting with providing precision application of eyeliner.

The enlarged element 44 has a diameter and cross sectional shape shaped and proportioned for easy handling and use. In some embodiments, the diameter is greater than about 1 cm (e.g., greater than about 1.5 cm, greater than about 2 cm). In some embodiments the diameter is less than about 5 cm (e.g., less than, 4 cm, less than about 3 cm, less than about 2.5 cm).

Figure 5C:
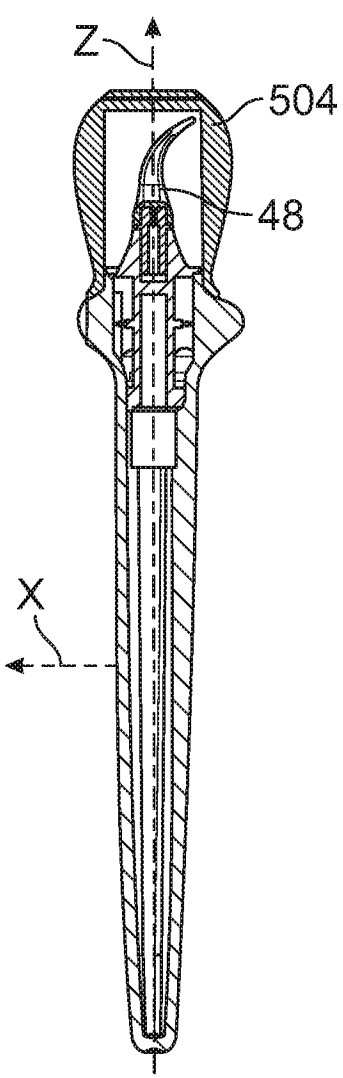
FIGS. 5A-5C show an assembly according to some embodiments of the invention.
Figure 5B:
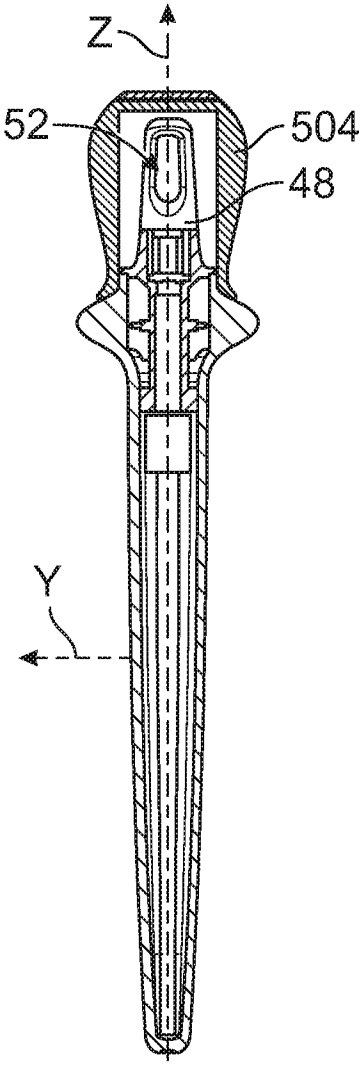
Figure 5A:
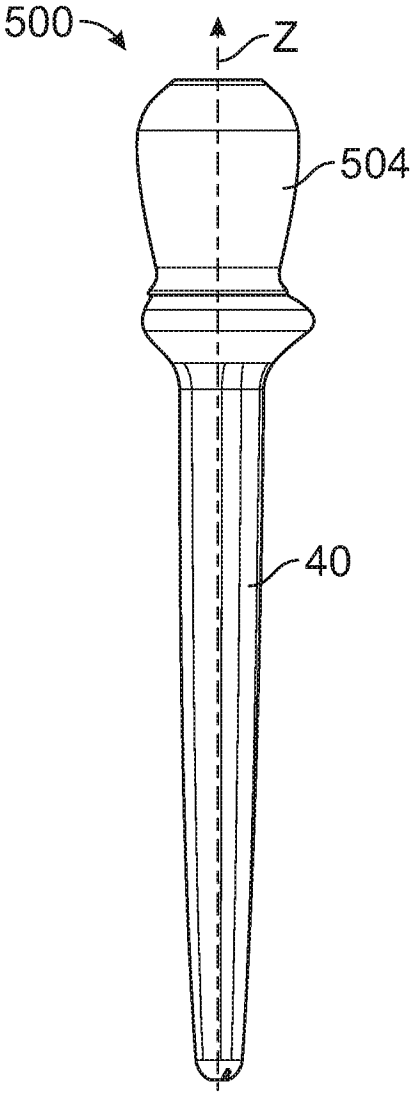

Turning now to FIGS. 5A-5C a non-limiting embodiment of an assembly 500 including a wand 40, an applicator 48, and a cap 504 is shown. A peek hole 52 is also shown. In some embodiments, the cap 504 is a vessel configured as a reservoir to contain a cosmetic formulation. The cap 504 can also be configured to seal onto the wand 40 proximate to the applicator 48 and end 46 of the wand 40 so that any contents in the cap 504 (e.g., the cosmetic formulation) generally do not leak out from the cap 504, and the applicator 48 is less likely to be contaminated by external materials or damaged during storage. The seal can be formed by any useful means between the cap 504 and the wand 40, such as grooves, snap-in elements, screw elements (e.g., having a matching helical thread feature on the cap 504 and wand 40 where the two contact one another), complementary tapers for securing the cap 504 to the wand 40, any combination thereof, or the like. In some embodiments the primary axis Z is the same for the wand 40, the applicator 48 and the cap 504.

Figure 6C:
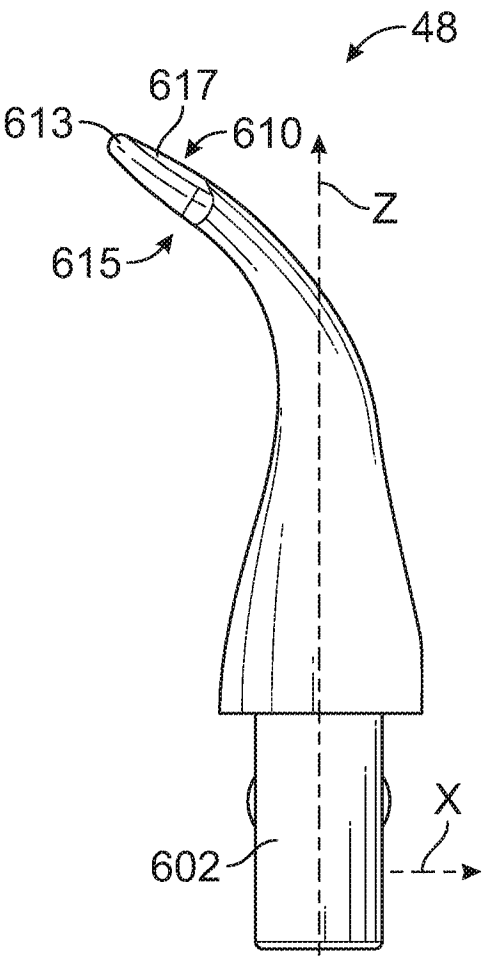
FIGS. 6A-6C show an embodiment of an applicator.
Figure 6B:
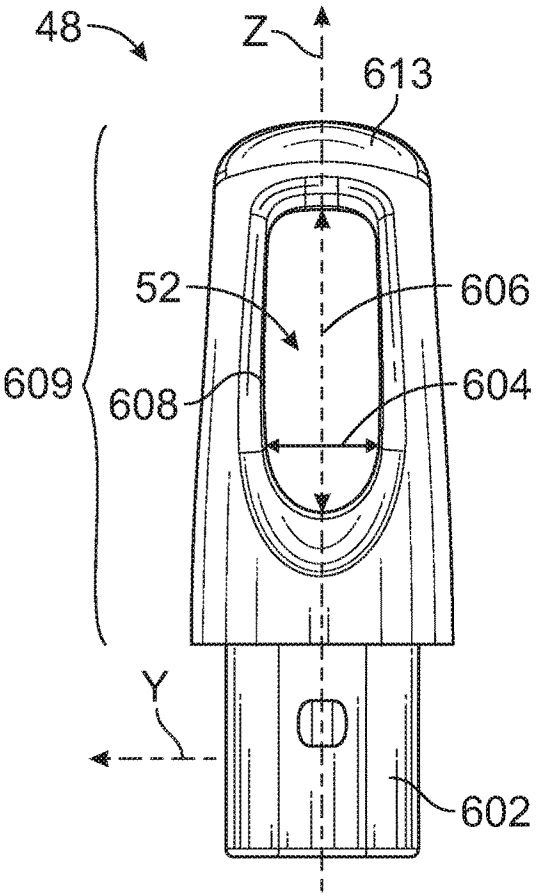
Figure 6A:
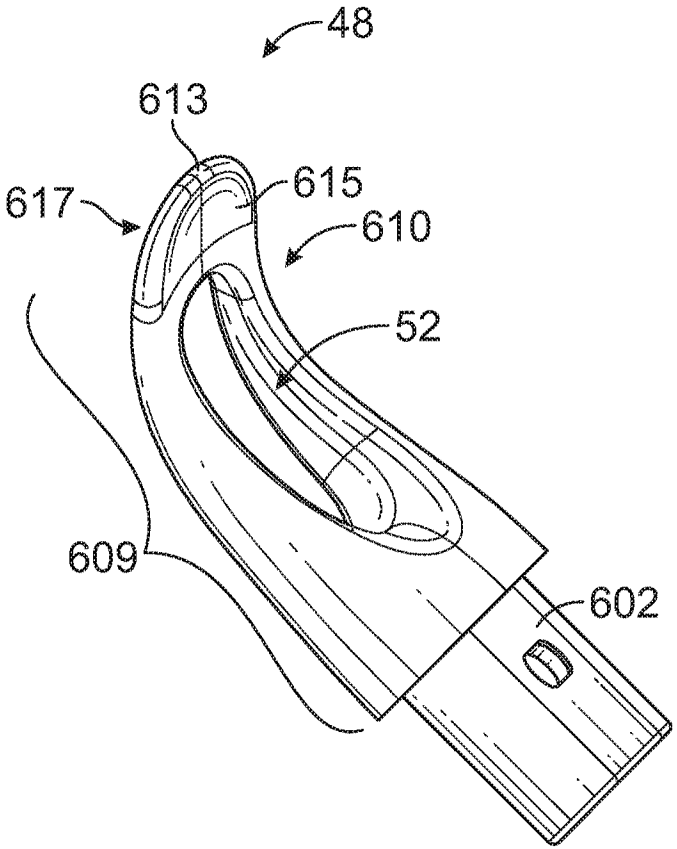

FIGS. 6A-6C illustrate an applicator 48 according to one non-limiting embodiment. A shaft or handle 602 of the applicator 48 as well as the peek hole 52 are shown. The peek hole 52 is disposed in a tip area 609 or region of the applicator 48 and configured to make it easier to apply makeup since it provides more visibility of the eye when using a mirror. A width 604 and height 606 dimension of peek hole 52 are indicated. These dimensions, 604 and 606, indicate the general direction and can include different numerical or scalar values such as between a minimum value and a maximum value as illustrated in the figures. That is, the peek hole width 604 can vary in value along the direction of axis Z and the peek hole height 606 can vary in the direction of axis Y. As such, the peek hole 52 may vary in size and shape in the different embodiments of the invention. In some embodiments the peek hole 52 is symmetric in one or more reflection planes, as shown in FIG. 6B. In some other embodiments, the peek hole 52 is not symmetric. In some embodiments, the viewing area is at least one centimeter square (e.g., at least 1 $cm^2$, at least 1.5 $cm^2$, at least 2 $cm^2$), wherein the viewing area is defined as the maximum area of projection through the peek hole 52. For example, the viewing area may be defined by the area circumscribed by edge 608 and projected on a plane perpendicular to axis X and Y. In some embodiments the minimum width 604 and/or minimum height 604 of the viewing area is at least 2 mm (e.g., at least 3 mm, at least 4 mm, at least 5 mm). The applicator 48 includes an application or working portion 610 which is configured for contact with the user's skin (e.g., an eyelid).

In some embodiments as shown in FIGS. 6A-6C, the tip area 609 can feature a wide application or working portion 610. As used herein, "wide" contrasts with a traditional eyeliner pencil tip which is more pointed, having one point or surface as the "working" surface. For example, the width of the working portion in the Y direction in some embodiments is at least 0.2 cm (e.g., at least 0.5 cm, at least 0.75 cm or at least 1 cm). In some embodiments the working surface is less than about 1 cm (e.g., less that about 0.75 cm, less that about 0.5 cm). As used herein the working portion 610 refers to the surface that is rubbed against the skin such as when applying a cosmetic formulation. The tip area 609 has a curved shape so that application or working portion 610 protrudes way from the principle axis Z. Some other features of the applicator 48 are that working portion 610 has multiple working surfaces and areas that can be used for contact with the eye area. In some embodiments, the working portion 610 has at least two working surfaces (e.g., at least 3). For example, the working portion 610 of FIGS. 6A-6C include a first surface 615, a second surface 617 and a third surface 613. At the first surface 615, the tip area 609 becomes thinner; that is, the distance between second surface 617 and the first surface 615 gets smaller, so that the surface area of 613 is small and allows a precision line of cosmetic formulation using the third surface 613 to be made. The first 615 and second 617 surfaces provide a wide surface for application of cosmetic formulations, for example, to the waterline of an eye.

The shaft 602 is configured to connect to the wand 40 and coupling element 43. This coupling can be as a male to female combination. For example, the coupling element 43 can include a hole or indentation that is configured to couple (e.g., connect, or accept) to the shaft 602. In some embodiments additional elements to help secure the applicator 48 through shaft 602 may be used, such a bearing elements, protrusions, tapers, threads, pins, fasteners, any a combination thereof, of the like. In some embodiments, magnetic means are used to secure the applicator 48 to the wand 40, such as having some ferrous material in the shaft 602 and a magnetic material in the coupling element 43, or a having ferrous material in element 43 and magnetic material in shaft 602. In another embodiment of a male to female combination, the coupling element 43, such as a hole or indentation is disposed on the applicator 48 and a protrusion or shaft on the wand 40 is configured to couple (e.g., connect, or accept) to the shaft 602.

In some embodiments the applicator 48 includes a flexible material such as a urethane or silicone. As used here "flexible" refers to material that may be easily bent such as with the force of a finger pushing on it, yet may hold its shape to allow use as, for example, an eyeliner applicator. Additionally, or alternatively, in some embodiments, the applicator 48 includes a material that is soft and comfortable for brushing or sliding across skin, e.g., near a delicate eye area. Some non-limiting examples of materials that can be used include silicone, thermoplastic polyurethane (TPU), thermoplastic elastomers (TPE) any combinations thereof, and the like. In some embodiments, the material comprises TPE, such as TPE that is injection molded. In addition to being made of a material that is soft yet holding its shape, the material, such as TPE, is easier to keep clean than, for example synthetic or natural brush hair.

In some embodiments the applicator, e.g., applicator 48, is disposable and, therefore, does not require washing and can be delivered and appropriately packed as a sterile item. In some embodiments the applicator is re-usable and is therefore washable and can be sterilized. Accordingly, the applicator, e.g., applicator 48, can be removably coupled to the wand 40. As used herein "removably" coupled or connected means that the applicator can be coupled or connected to the wand 40 more than one time without damaging the wand 40 and/or the applicator 48.

In some embodiments the applicator, such as applicator 48 is coupled to be an integral unit with the wand 40. For example, the applicator such as 48 is not removable from the wand 40.

The applicator 48 can be used with many holders not limited to wands such as wand 40. For example, the applicator 48 may be used with holders having a round or egg shape.

Figure 7:
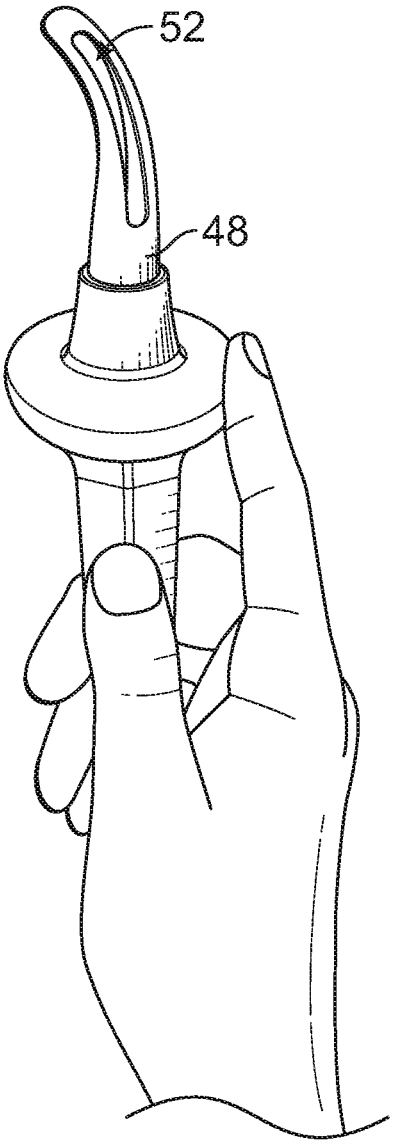
FIG. 7 shows a user's hand grasping a wand fitted with the applicator.

FIG. 7 shows a user's hand grasping a wand fitted with the applicator 48. As previously described and shown, the user's fingers can be disposed around the wand grip firmly and securely, yet in a relaxed and ergonomically favorable manner. This type of grip can be contrasted with other handles for utensils such as a knife handle, hammer handle, or a bat handle, which are configured for gripping in a first like manner for power or for directing force to a working end.

Figure 8:
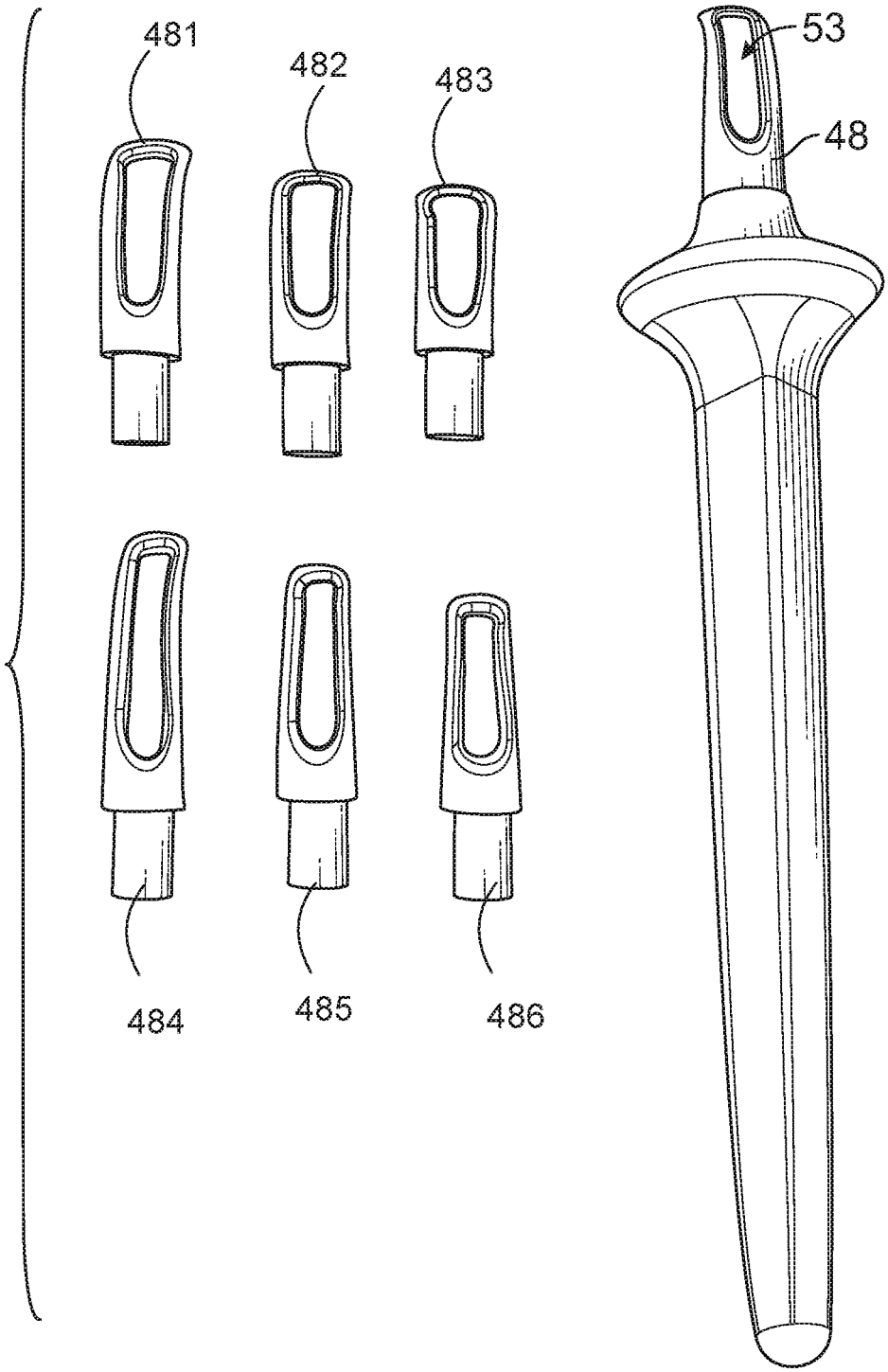
FIG. 8 shows various embodiments of applicator and wand according to embodiments of the invention.

FIG. 8 shows an embodiments of a kit comprising an applicator 48 and the wand 40. For example, applicator 481, 482, 483, 484, 484, and 486. As shown, the applicators include holes 52 having differing configurations and shapes useful for different application or makeup. In some embodiments other applicators such as brushes can be attached to the wand 40 and included in the kit. In some embodiments the kit can include other items such as cosmetic or skincare application formulations. The kit can also include a container for holding the kit items such as one or more of applicators 48, 481, 482, 483, 484, 484, 486, brush applicators, spooliess, one or more wands (e.g., wand 40 or this like), containers holding cosmetic or skincare application formulations, and a mirror. The kit container can include indentations, grooves, straps, bands or other means for keeping the items there in place.

The cosmetic applicator wand and applicators attached thereto such as, but not limited to, the applicator 48, can be used for many cosmetic or skincare applications. For example, the applicators and/or holders described herein may be used for applying creams, emulsions, lotions, liquids, serums, oils, powders, solutions, ointments, pastes, suspensions, balms, gels, sticks, sprays, ny combinations thereof, and the like. The applicators and/or holders can be used for the application of makeup, skincare, bath and body, and/or hair products including, but not limited to, the following: eye makeup such as brow pencils and fillers, mascara, eyeliner, eyeshadow, primer, hair (e.g., lash or brow) conditioners and treatments, false eyelashes, lash curlers; face makeup such as primers, foundations, concealers, powders, highlighters/brightening pigments, blush and contour, and setting sprays; lip cosmetics such as, lipstick, lip gloss, lip stains, lip balms, lip liners, exfoliates and conditioning treatments; and skincare such as cleansers, exfoliators, masks, moisturizers and anti-aging treatments.

As used herein, the term "comprising" or "comprises" is used in reference to compositions, methods, and respective component(s) thereof, that are essential to the claimed invention, yet open to the inclusion of unspecified elements, whether essential or not.

As used herein, the term "consisting essentially of" refers to those elements required for a given embodiment. The term permits the presence of elements that do not materially affect the basic and novel or functional characteristic(s) of that embodiment of the claimed invention.

The term "consisting of" refers to compositions, methods, and respective components thereof as described herein, which are exclusive of any element not recited in that description of the embodiment.

As used in this specification and the appended claims, the singular forms "a," "an," and "the" include plural references unless the context clearly dictates otherwise. Thus, for example, references to "the method" includes one or more methods and/or steps of the type described herein and/or that will become apparent to those persons skilled in the art upon reading this disclosure and so forth. Similarly, the word "or" is intended to include "and" unless the context clearly indicates otherwise.

Other than in the operating examples, or where otherwise indicated, all numbers expressing quantities of ingredients or reaction conditions used herein should be understood as modified in all instances by the term "about." The term "about," when used in connection with percentages, may mean±5% (e.g., ±4%, ±3%, ±2%, ±1%) of the value being referred to.

Where a range of values is provided, each numerical value between the upper and lower limits of the range is contemplated and disclosed herein.

Unless otherwise defined herein, scientific and technical terms used in connection with the present application shall have the meanings that are commonly understood by those of ordinary skill in the art. Further, unless otherwise required by context, singular terms shall include pluralities, and plural terms shall include the singular.

It should be understood that the embodiments disclosed herein are not limited to the particular methodology, protocols, and reagents, etc., described herein and as such may vary. The terminology used herein is for the purpose of describing particular embodiments only and is not intended to limit the scope of the present invention, which is defined solely by the claims.

Embodiments of the various aspects described herein can be illustrated by the following numbered paragraphs.

1. A cosmetic applicator wand in the form of an elongated tool comprising,
   a stem portion disposed between a first end and a second end of the elongated tool, the stem portion including a region configured to be gripped by a user,
   an applicator coupling element at the first end of the elongated tool, and
   an enlarged element disposed between the region configured to be gripped by the user and the applicator coupling element.

2. The cosmetic applicator wand according to paragraph 1, wherein the region configured to be gripped by the user has a cross sectional shape of a circle, an oval, or an n-sided shape, where n is an integer between three and 10.

3. The cosmetic applicator wand according to paragraph 1 or 2, wherein the region configured to be gripped by the user is textured for secure gripping by the user.

4. The cosmetic applicator wand according to any one of paragraphs 1-3, wherein the stem is tapered, having a larger cross section area at a position proximate to the enlarged element and a smaller cross section area at a position distal from the enlarged element.

5. The cosmetic applicator wand according to any one of paragraphs 1-4, wherein the enlarged element includes a groove (e.g., a finger groove).

6. The cosmetic applicator wand according to any one of paragraphs 1-5, wherein the groove has an arcuate surface.

7. The cosmetic applicator wand according to any one of paragraphs claim 1-6, wherein the enlarged element has a diameter smaller than about 5 cm.

8. The cosmetic applicator wand according to any one of paragraphs 1-7, wherein the applicator coupling element is configured to removably couple with a handle of an applicator, wherein a primary axis of the elongated tool and a primary axis of the applicator handle are substantially parallel.

9. The cosmetic applicator wand according to claim 1, wherein the coupling element and applicator handle comprise a male and female coupling combination, for example wherein the coupling element comprises an indentation for placement of one end of an applicator handle therein, or the coupling element comprise a protrusion and the applicator handle comprise an indentation for placement of the protrusion therein.

10. A cosmetic applicator comprising,
   a shaft and an applicator tip, wherein the applicator tip is curved away from a principle axis of the shaft and includes a through hole configured as a peek or see-through hole.

11. The cosmetic applicator as in paragraph 10, wherein the applicator comprises a silicone, thermoplastic polyurethane (TPU), thermoplastic elastomers (TPE), or combinations thereof.

12. The cosmetic applicator as in paragraph 10 or 11, wherein the applicator tip comprises at least two working surfaces for applying a cosmetic formulation.

13. The cosmetic applicator as in any one of paragraphs 10-12, wherein the applicator can be removably attached to a holder.

14. An assembly for application of a cosmetic comprising,
   a cosmetic applicator wand in the form of an elongated tool and an applicator comprising an applicator shaft and an applicator tip, the applicator tip comprising an application surface for applying a cosmetic formulation to skin,
   wherein the applicator wand comprises,
   a stem portion disposed between a first end and a second end of the elongated tool, the stem portion including a region configured to be gripped by a user,
   an applicator coupling element at the first end of the elongated tool, and
   an enlarged element disposed between the region configured to be gripped by the user and the applicator coupling element, and
   wherein the applicator shaft is coupled to the wand at the first end of the elongated tool using the applicator coupling element.

15. The assembly according to paragraph 14, wherein the applicator tip comprises a through hole configured as a peek hole.

16. The assembly according to paragraph 14 or 15, further comprising a vessel configured as a reservoir for a cosmetic formulation and configured for sealing to the wand proximate to the first end of the elongated tool.

17. A method for applying a cosmetic formulation to a subject comprising, holding the assembly of paragraph 14 using the stem portion of the elongated element and contacting the application surface of the applicator to an eyelid or eyebrow of the subject.

18. The method of paragraph 17, further comprising grounding the enlarged element against the face of the subject.

19. The method of paragraph 17 or 18, wherein grounding comprises rolling or sliding the element against the face of the subject.

20. The method of any one paragraphs 17-19, wherein the assembly of claim 13 includes a groove disposed for resting a finger, such an index finger, thereupon and holding the assembly includes resting a finger on the groove.

What is claims is:

1. A cosmetic applicator wand in the form of an elongated tool comprising, a stem portion disposed between a first end and a second end of the elongated tool, the stem portion including a region configured to be gripped by a user, an applicator coupling element at the first end of the elongated tool, and an enlarged element disposed between the region configured to be gripped by the user and the applicator coupling element, wherein the enlarged element includes a groove, and an applicator configured for coupling to the coupling element, the applicator including an applicator tip, wherein the applicator tip is curved away from the primary axis of the applicator handle and the applicator tip includes a through hole.

2. The cosmetic applicator wand according to claim 1, wherein the region configured to be gripped by the user has a cross sectional shape of a circle, an oval, or an n-sided shape, where n is an integer between three and 10.

3. The cosmetic applicator wand according to claim 1, wherein the region configured to be gripped by the user is textured for secure gripping by the user.

4. The cosmetic applicator wand according to claim 1, wherein the stem is tapered, having a larger cross section area at a position proximate to the enlarged element and a smaller cross section area at a position distal from the enlarged element.

5. The cosmetic applicator wand according to claim 1, wherein the groove has an arcuate surface.

6. The cosmetic applicator wand according to claim 1, wherein the enlarged element has a diameter smaller than about 5 cm.

7. The cosmetic applicator wand according to claim 1, wherein the applicator coupling element is configured to removably couple with a handle of the applicator, wherein a primary axis of the elongated tool and a primary axis of the applicator handle are substantially parallel.

8. The cosmetic applicator wand according to claim 1, wherein the coupling element and applicator handle comprise a male and female coupling combination.

9. The cosmetic applicator as in claim 1, wherein the applicator consists of a silicone, a thermoplastic polyurethane (TPU), a thermoplastic elastomers (TPE), and combinations thereof.

10. The cosmetic applicator as in claim 1, wherein the applicator tip comprises at least two working surfaces for applying a cosmetic formulation.

11. An assembly for application of a cosmetic comprising, a cosmetic applicator wand in the form of an elongated tool and an applicator comprising an applicator shaft and an applicator tip, the applicator tip comprising an application surface for applying a cosmetic formulation to skin, wherein the applicator wand comprises, a stem portion disposed between a first end and a second end of the elongated tool, the stem portion including a region configured to be gripped by a user, an applicator coupling element at the first end of the elongated tool, and an enlarged element disposed between the region configured to be gripped by the user and the applicator coupling element, wherein the applicator shaft is coupled to the wand at the first end of the elongated tool using the applicator coupling element, wherein the enlarged element includes a groove, and wherein the applicator tip is curved away from the primary axis of the applicator handle and the applicator tip includes a through hole.

12. The assembly according to claim 11, further comprising a vessel configured as a reservoir for a cosmetic formulation and configured for sealing to the wand proximate to the first end of the elongated tool.

13. A method for applying cosmetic formulation to a subject comprising:

holding an assembly, the assembly comprising;

a cosmetic applicator wand in the form of an elongated tool and an applicator comprising an applicator shaft and an applicator tip, the applicator tip comprising an application surface for applying a cosmetic formulation to skin, wherein the applicator wand comprises, a stem portion disposed between a first end and a second end of the elongated tool, the stem portion including a region configured to be gripped by a user, an applicator coupling element at the first end of the elongated tool, and an enlarged element disposed between the region configured to be gripped by the user and the applicator coupling element, wherein the applicator shaft is coupled to the wand at the first end of the elongated tool using the applicator coupling element, wherein the enlarged element includes a groove, and using the stem portion of the elongated element and contacting the application surface of the applicator to an eyelid or eyebrow of the subject, and grounding the enlarged element against the face of the subject.

14. The method of claim 13, wherein grounding comprises rolling or sliding the element against the face of the subject.

15. The method of claim 13, wherein holding the assembly includes resting a finger on the groove.

* * * * *